US011390490B2

(12) United States Patent
Bhaskar

(10) Patent No.: US 11,390,490 B2
(45) Date of Patent: Jul. 19, 2022

(54) CANTILEVERED CLIMBING ELEVATOR

(71) Applicant: OTIS ELEVATOR COMPANY, Farmington, CT (US)

(72) Inventor: Kiron Bhaskar, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 178 days.

(21) Appl. No.: 16/747,845

(22) Filed: Jan. 21, 2020

(65) Prior Publication Data

US 2021/0221646 A1 Jul. 22, 2021

(51) Int. Cl.

| | |
|---|---|
| ***B66B 9/02*** | (2006.01) |
| ***B66B 7/02*** | (2006.01) |
| ***B66B 11/04*** | (2006.01) |
| ***B66B 11/00*** | (2006.01) |
| ***B66B 7/04*** | (2006.01) |

(52) U.S. Cl.

CPC ..... *B66B 9/02* (2013.01); *B66B 7/022* (2013.01); *B66B 7/046* (2013.01); *B66B 11/0085* (2013.01); *B66B 11/0476* (2013.01)

(58) Field of Classification Search

CPC ..... B66B 7/022; B66B 7/046; B66B 9/02; B66B 11/0085; B66B 11/0476

See application file for complete search history.

(56) References Cited

U.S. PATENT DOCUMENTS 1,931,237 A * 10/1933 O'Connell ..... B66B 5/18 187/359
3,880,258 A * 4/1975 Rompa ..... B66B 7/022 187/239
5,152,374 A * 10/1992 Pokus ..... B66B 9/02 187/249
5,464,072 A * 11/1995 Muller ..... B66B 9/02 187/249
5,566,784 A * 10/1996 Rennetaud ..... B66B 9/02 187/249
5,713,432 A * 2/1998 Richter ..... B66B 11/0206 187/250

(Continued)

FOREIGN PATENT DOCUMENTS

EP 0681984 A1 * 11/1995 ..... B66B 9/02
EP 1642827 A2 * 4/2006 ..... B66B 11/0206

(Continued)

*Primary Examiner* — Minh Truong

(74) *Attorney, Agent, or Firm* — Carlson, Gaskey & Olds, P.C.

(57) ABSTRACT

An illustrative example embodiment of an elevator includes an elevator car frame. A drive mechanism is situated near only one side of the elevator car frame. The drive mechanism includes at least one rotatable drive member that is configured to engage a vertical surface near the one side of the elevator car frame, selectively cause movement of the elevator car frame as the rotatable drive member rotates along the vertical surface, and selectively prevent movement of the elevator car frame when the drive member does not rotate relative to the vertical surface. A biasing mechanism urges the rotatable drive member in a direction to engage the vertical surface. At least one stabilizer is situated near the one side of the elevator car frame and is configured to prevent the elevator car frame from tipping away from the vertical surface.

12 Claims, 4 Drawing Sheets

(56) References Cited

U.S. PATENT DOCUMENTS

| | | | | |
|---|---|---|---|---|
| 8,235,178 | B2 * | 8/2012 | Kocher | B66B 9/02 187/250 |
| 8,863,907 | B2 * | 10/2014 | Studer | B66B 9/022 187/270 |
| 2005/0005809 | A1 * | 1/2005 | Neale | A62B 1/02 104/93 |
| 2019/0077636 | A1 | 3/2019 | Bhaskar | |
| 2019/0077637 | A1 | 3/2019 | Bhaskar | |

FOREIGN PATENT DOCUMENTS

| | | | | |
|---|---|---|---|---|
| ES | 2283217 | A1 * | 10/2007 | B66B 9/022 |
| FR | 2817542 | A1 * | 6/2002 | B66B 9/02 |
| WO | WO-2011142647 | A1 * | 11/2011 | B66B 9/02 |

* cited by examiner

CANTILEVERED CLIMBING ELEVATOR

BACKGROUND

Elevator systems have proven useful for carrying passengers among various levels within a building. There are various types of elevator systems. For example, some elevator systems are considered hydraulic and include a piston or cylinder that expands or contracts to cause movement of the elevator car. Other elevator systems are traction-based and include roping between the elevator car and a counterweight. A machine includes a traction sheave that causes movement of the roping to achieve the desired movement and positioning of the elevator car. Hydraulic systems are generally considered useful in buildings that have a few stories while traction systems are typically used in taller buildings.

Each of the known types of elevator systems has features that present challenges for some implementations. For example, although traction elevator systems are useful in taller buildings, in ultra-high rise installations the roping is so long that it introduces appreciable mass and expense. Sag due to roping stretch and bounce of the elevator car are other issues associated with longer roping Additionally, longer roping and taller buildings are more susceptible to sway and drift, each of which requires additional equipment or modification to the elevator system.

SUMMARY

An illustrative example embodiment of an elevator includes an elevator car frame. A drive mechanism is situated near only one side of the elevator car frame. The drive mechanism includes at least one rotatable drive member that is configured to engage a vertical surface near the one side of the elevator car frame, selectively cause movement of the elevator car frame as the rotatable drive member rotates along the vertical surface, and selectively prevent movement of the elevator car frame when the drive member does not rotate relative to the vertical surface. A biasing mechanism urges the rotatable drive member in a direction to engage the vertical surface. At least one stabilizer is situated near the one side of the elevator car frame and is configured to prevent the elevator car frame from tipping away from the vertical surface.

In an embodiment having one or more features of the elevator of the previous paragraph, the at least one rotatable drive member comprises a wheel and a motor supported at least partially within the wheel.

In an embodiment having one or more features of the elevator of any of the previous paragraphs, the at least one rotatable drive member comprises a second wheel.

In an embodiment having one or more features of the elevator of any of the previous paragraphs, the second wheel includes a motor supported at least partially within the second wheel.

In an embodiment having one or more features of the elevator of any of the previous paragraphs, the biasing mechanism comprises at least one beam supported for movement in a first direction to urge the at least one rotatable drive member in the direction to engage the vertical surface and the at least one beam moves in the first direction based upon a force in a second, different direction.

In an embodiment having one or more features of the elevator of any of the previous paragraphs, the first direction is horizontal and the second direction is vertical.

In an embodiment having one or more features of the elevator of any of the previous paragraphs, the force is based on a load on the elevator car frame.

In an embodiment having one or more features of the elevator of any of the previous paragraphs, the at least one rotatable drive member comprises two drive wheels situated to engage oppositely facing vertical surfaces, the at least one beam comprise two beams, each of the two beams has a first end and a second end, the beams are respectively associated with one of the drive wheels, the beams are supported for pivotal movement relative to the elevator car frame in response to the force, the first ends of the beams move toward each other in response to an increase in the force, and the second ends of the beams move away from each other in response to the increase in the force.

In an embodiment having one or more features of the elevator of any of the previous paragraphs, the biasing mechanism includes an actuator portion that moves in the second direction in response to a change in the force, the actuator portion moves in response to the increase in the force to cause movement of the first ends of the beams toward each other, and the actuator portion moves in response to a decrease in the force to allow movement of the first ends of the beams away from each other.

In an embodiment having one or more features of the elevator of any of the previous paragraphs, the actuator portion moves along the second direction.

In an embodiment having one or more features of the elevator of any of the previous paragraphs, the actuator portion includes an angled surface that has a first profile along a portion of the angled surface and a second profile along a second portion of the angled surface, the first profile includes a first angle that is steeper than a second angle of the second portion, and the second portion of the angled surface causes movement of the first ends of the beams in response to the force being above a preselected threshold.

In an embodiment having one or more features of the elevator of any of the previous paragraphs, the second profile includes a curved surface.

In an embodiment having one or more features of the elevator of any of the previous paragraphs and comprising a vertical support member that includes the vertical surface, the vertical support member includes at least one reaction surface that is transverse to the vertical surface; and the stabilizer is received against the at least one reaction surface.

In an embodiment having one or more features of the elevator of any of the previous paragraphs, the vertical support comprises an I-beam having a web and a flange at each end of the web, the web defines the vertical surface, and at least one of the flanges defines the at least one reaction surface.

In an embodiment having one or more features of the elevator of any of the previous paragraphs, the stabilizer comprises at least one roller that is received against the at least one reaction surface on the at least one of the flanges.

An embodiment having one or more features of the elevator of any of the previous paragraphs includes a cabin supported on the elevator car frame, a sensor that provides an output indicating a load in the elevator car, and a processor that determines the load in the elevator car based on the output of the sensor. The biasing mechanism comprises an actuator that is controlled by the processor to change a force for urging the at least one rotatable drive member in the direction to engage the vertical surface based on a change in the load in the elevator car.

In an embodiment having one or more features of the elevator of any of the previous paragraphs, the actuator increases the force for urging the at least one rotatable drive member in the direction to engage the vertical surface based on an increase in the load in the elevator car and decreases the force for urging the at least one rotatable drive member in the direction to engage the vertical surface based on a decrease in the load in the elevator car.

The various features and advantages of at least one disclosed example embodiment will become apparent to those skilled in the art from the following detailed description. The drawings that accompany the detailed description can be briefly described as follows.

DETAILED DESCRIPTION

Figure 1:
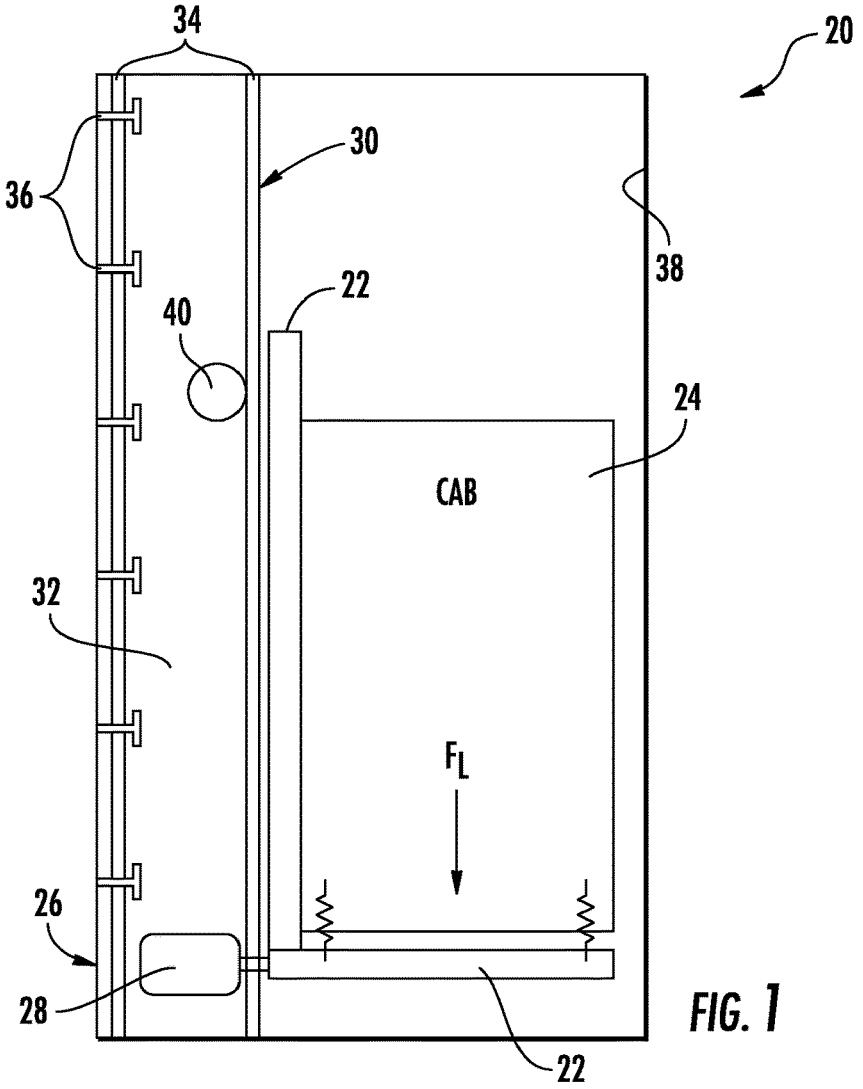
FIG. 1 schematically illustrates selected portions of an example embodiment of an elevator system.
Figure 2:
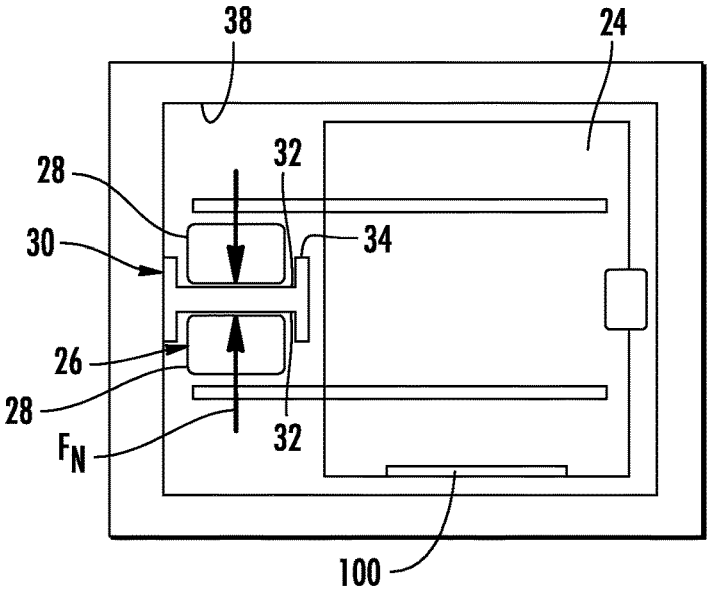
FIG. 2 schematically illustrates selected features of the embodiment of FIG. 1 viewed from underneath the elevator car.

FIG. 1 schematically illustrates selected portions of an elevator system 20. An elevator car frame 22 supports a cab 24. A drive mechanism 26 is supported by the elevator car frame 22. An elevator controller (not illustrated) controls operation of the drive mechanism 26 to move or park the elevator car frame 22 and cab 24 as needed to provide elevator service to passengers. The drive mechanism 26 includes at least one rotatable drive member 28 that is configured to engage a vertical surface. The rotatable drive member 28 selectively causes vertical movement of the elevator car frame 22 and the cab 24 as the rotatable drive member 28 rotates and moves along the vertical surface. The rotatable drive member 28 maintains a desired vertical position of the elevator car frame 22 when the rotatable drive member 28 remains stationary and does not rotate. As can be seen in FIG. 2, for example, the illustrated example embodiment includes two rotatable drive members 28.

In the illustrated example embodiment, the drive mechanism 26 and the rotatable drive members 28 are situated near the bottom of the elevator car frame 22. This arrangement takes advantage of the structural rigidity at the lower portion of an elevator car frame.

The example embodiment includes a structural member 30 in the form of an I-beam that includes a web 32 and flanges 34. The web 32 defines a vertical surface that the rotatable drive members 28 engage. In the illustrated example embodiment, the rotatable drive members 28 engage opposite sides of the web 32. The rotatable drive members 28 engage the web 32 with sufficient force to achieve traction for controlling vertical movement and position of the elevator car frame 22 and the cab 24.

In the illustrated example embodiment, the structural member 30 is secured by mounting brackets 36 to one side of a hoistway 38. Other embodiments include a structural member that is made as part of the hoistway 38 or a corresponding portion of the building in which the elevator system 20 is installed. There are a variety of ways of providing a vertical surface 32 that can be engaged by one or more rotatable drive members 28 for purposes of propelling and supporting the elevator car frame 22 and cab 24.

The drive mechanism 26 is situated on only one side of the elevator car frame 22. This results in a cantilevered arrangement of the elevator car frame 22. A stabilizer 40 is provided near the one side of the elevator car frame 22 to prevent the elevator car frame 22 from tipping away from the structural member 30. In this example, the stabilizer 40 includes at least one roller that engages a surface on at least one of the flanges 34 of the I-beam structural member 30. In some embodiments, the stabilizer 40 includes rollers configured like guide rollers on known elevator systems.

Figure 3:
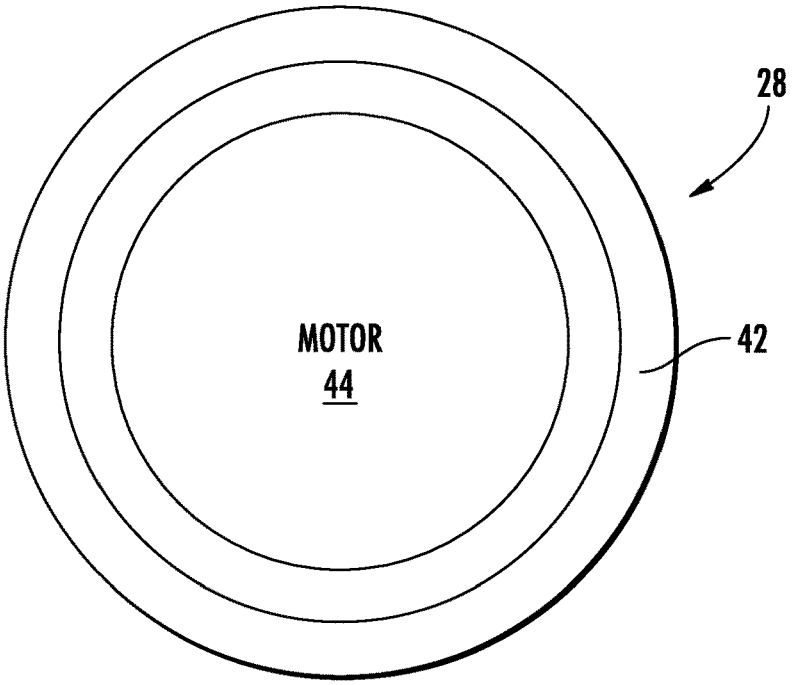
FIG. 3 schematically illustrates an example rotatable drive member useful, for example, with the embodiment shown in FIG. 1.

FIG. 3 illustrates an example rotatable drive member 28. A wheel or tire 42 provides the engagement surface for engaging the vertical surface 32 to achieve sufficient traction for controlling movement of the elevator car frame 22. A motor 44 in this example embodiment is situated within the rotatable drive member 28, which provides a compact arrangement of components that is capable of achieving the necessary torque to cause desired movement and stable positioning of the elevator car frame 22 based on engagement with the vertical surface 32.

Figure 4:
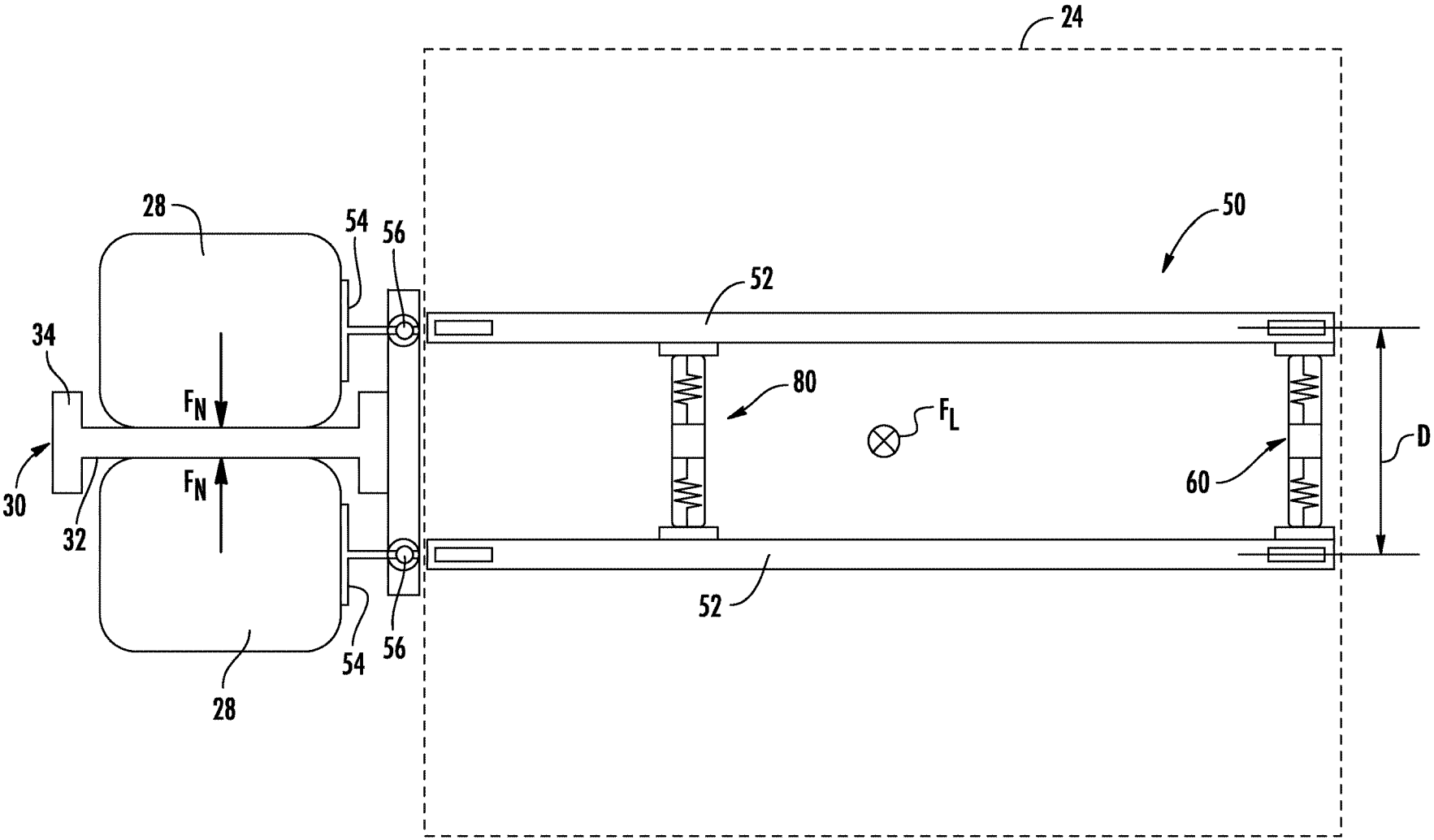
FIG. 4 schematically illustrates an example configuration of a biasing mechanism for urging rotatable drive members in a direction to engage a vertical surface.

FIG. 4 schematically illustrates a biasing mechanism 50 that urges the rotatable drive members 28 into engagement with the example vertical surface 32. The biasing mechanism 50 includes beams 52 that are associated with drive member supports 54. In this example, the drive member supports 54 and the beams 52 are situated for pivotal movement relative to the elevator car frame 22 (FIG. 1) about pivots 56. In this example, first ends of the beams 52 are situated near the drive member supports 54 while second ends of the beams 52 are distal from the rotatable drive members 28.

At least one actuator 60 selectively changes a distance D between the second ends of the beams 52 to change the engagement force $F_N$ with which the rotatable drive members 28 engage the vertical surfaces of the web 32 of the I-beam structural member 30. The actuator 60 changes the distance D in response to a change in a load in the elevator cab 24. The load in the cab 24 imposes a downward force $F_L$. The actuator 60 urges the rotatable drive members 28 in a direction to engage the vertical surfaces on the web 32 of the I-beam structural member 30. In the illustrated example embodiment, the movement of the beams 52 is in a first direction, which is horizontal, and the force associated with the load in the elevator cab 24 is in a second direction, which is vertical. In the illustrated example embodiment, the first direction is perpendicular to the second direction.

The actuator 60 facilitates changing the amount of engagement force or normal force $F_N$ to accommodate differences in load in the elevator car 24. Such an arrangement facilitates maintaining adequate traction between the drive mechanism 26 and the structural member 30 without maintaining forces or conditions that would tend to introduce additional wear on the components of the drive mechanism 26 or the structural member 30, for example.

Figure 5:
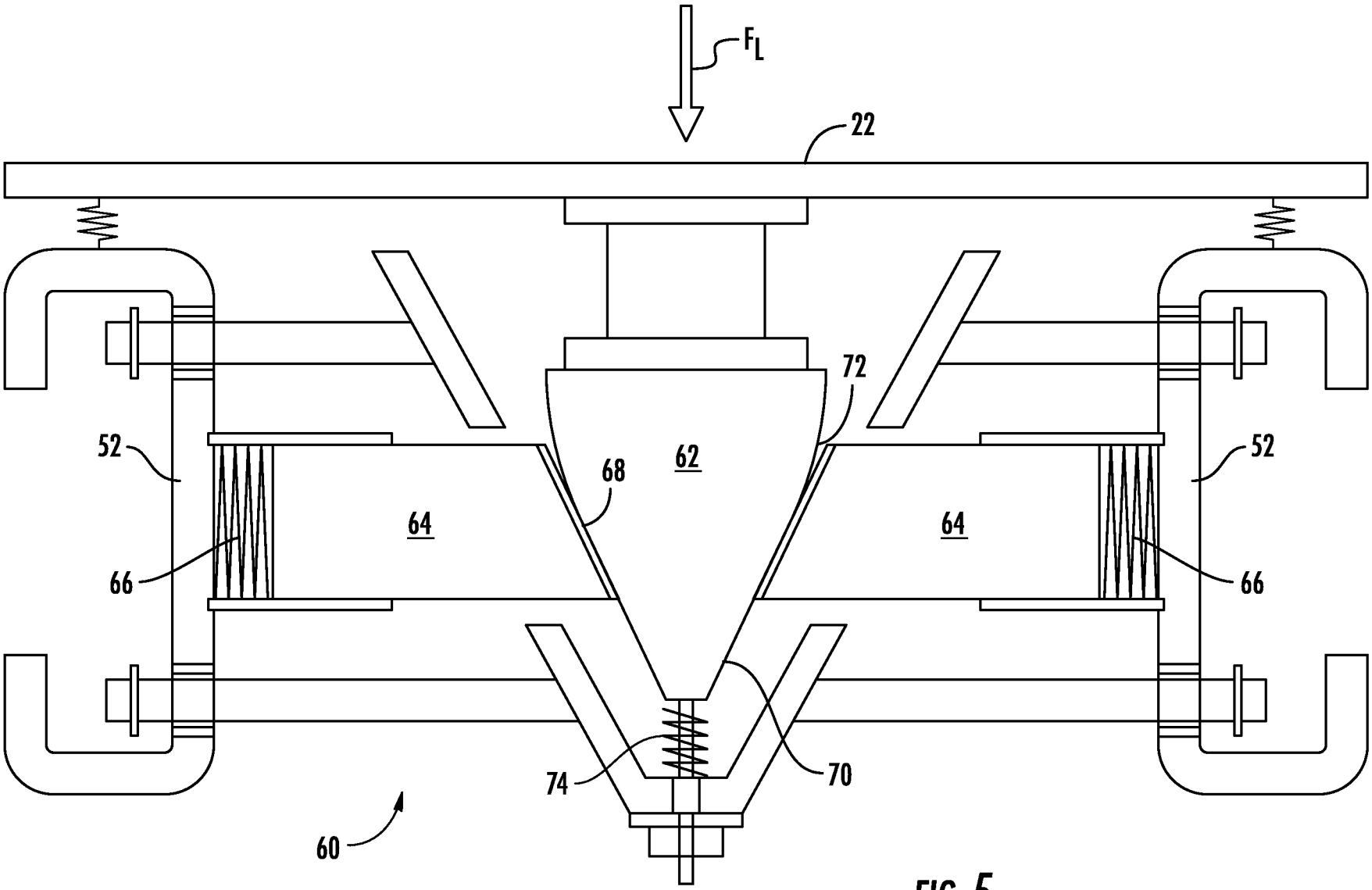
FIG. 5 schematically illustrates an example actuator portion of the biasing mechanism shown in FIG. 4.

FIG. 5 illustrates an example arrangement of an actuator 60. In this example, a wedge-shaped actuator portion 62 moves in response to the force $F_L$ caused by the load in the elevator cab 24. Downward movement (according to the drawing) of the wedge-shaped actuator portion 62 causes sideways and outward movement (according to the drawing) of intermediate members 64 against the bias of springs 66. As the intermediate members 64 move outward, they urge the nearby second ends of the beams 52 to spread apart increasing the distance D shown in FIG. 4.

In this example embodiment, the wedge-shaped actuator portion 62 engages a ramped surface 68 on the intermediate members 64. The outer surface of the actuator portion 62 and the ramped surfaces 68 are coated with a low friction material in some embodiments. The wedge-shaped actuator portion 62 includes an angled surface that has a first profile 70 along a portion of the angled surface and a second profile 72 along another portion of the angled surface. The first profile 70 includes a steeper angle than an angle of the second profile 72. Additionally, the second profile 72 includes a curvature. The second profile 72 reduces the frictional load associated with engaging the angled surfaces 68 as the force $F_L$ increases. The second profile 72 compensates for an increase in the co-efficient of friction by reducing the effect of the normal force at the interface of the second profile 72 and the angled surfaces 68 under higher loads in the elevator cab 24.

As can be appreciated from FIGS. 4 and 5, as the force $F_L$ increases, the actuator 60 increases the distance D, which results in the rotatable drive members 28 moving toward the vertical surfaces on the web 32 of the I-beam structural member 30. In other words, the actuator 60 increases the engagement force between the rotatable drive members 28 and the vertical surfaces 32 based upon an increase in the load in the elevator cab 24. An increased engagement force provides the appropriate amount of traction for achieving desired movement of the elevator car frame 22 and for parking the cab 24 at a desired landing.

As shown in FIG. 4, a counterbalancing mechanism 80 provides a bias for urging the beams 52 back toward a default position corresponding to a minimum amount of normal force $F_N$ applied by the rotatable drive members 28 to the vertical surfaces 32. the minimum normal force $F_N$ is useful for conditions such as an empty elevator cab 24. As the load in the elevator cab 24 decreases, a spring 74 (FIG. 5) urges the wedge-shaped actuator portion 62 in an upward direction (according to the drawing). Under those conditions, the counterbalancing mechanism 80 urges the first ends of the beams 52 apart and decreases the distance D between the second ends of the beams 52.

Figure 6:
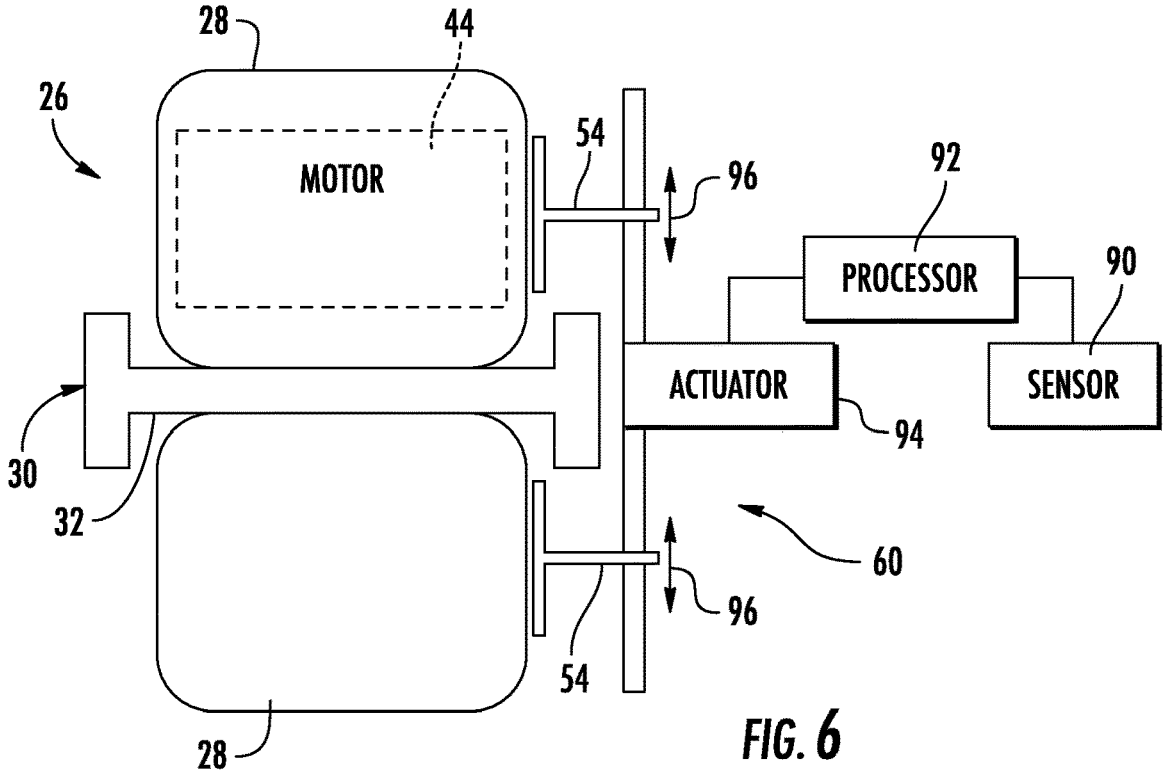
FIG. 6 schematically illustrates another example embodiment of a biasing mechanism.

FIG. 6 schematically illustrates another example embodiment in which a sensor 90 provides an output indicating the load in the elevator car 24 to a processor 92. An actuator 94, such as an electric linear actuator, changes a position of the rotatable drive members 28 relative to the structural members 30 as schematically shown by the arrows 96 to alter the engagement force based on changes in the load as indicated by the sensor 90. The processor 92 controls the actuator 94 to achieve a desired engagement force corresponding to the current load in the elevator car 24.

The illustrated example embodiments include various features that can be advantageous. For example, situating the drive mechanism 26 on only one side of the elevator car frame 22 leaves more room in the hoistway 38 to accommodate a larger sized elevator cab 24 or a variety of car configurations. Additionally, it is possible to position a door 100 (FIG. 2) of the elevator car on any of the three remaining sides of the elevator cab 24 other than the one that the drive mechanism 26 is situated near. In addition to utilizing hoistway space more efficiently, less material is required with a drive mechanism near only one side of the elevator car frame. Reducing the required amount of materials reduces the costs of an elevator system.

Other features of example embodiments include reduced installation time, which is due for example to the requirement for only one structural member on only one side of the elevator car. Additionally, the structural member may be more strategically placed where load rated attachment points are more easily or more effectively accommodated inside the hoistway.

Another feature of example embodiments is that it becomes more straightforward to incorporate more than one elevator car in a single hoistway. Multiple cars can use the same structural member without complicated arrangements to avoid interference between the operative components of the drive mechanisms for each car. Some embodiments include the ability to transfer elevator cars among different hoistways. The United States Patent Application Publications US 2109/0077636 and US 2109/0077637 each show ways of transferring elevator cars among hoistways and having more than one car in a hoistway. The teachings of those two published applications are incorporated by reference into this description.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. An elevator, comprising:

an elevator car frame;

a drive mechanism situated near only one side of the elevator car frame, the drive mechanism including two drive wheels configured to engage oppositely facing vertical surfaces near the one side of the elevator car frame, selectively cause movement of the elevator car frame as the drive wheels rotate along the vertical surfaces, and selectively prevent movement of the elevator car frame when the drive wheels do not rotate relative to the vertical surfaces;

a biasing mechanism comprising two beams, wherein each of the two beams has a first end and a second end, the beams are respectively associated with one of the drive wheels, the beams are supported for pivotal movement relative to the elevator car frame in response to a force that urges the drive wheels in a direction to engage the vertical surfaces, the first ends of the beams move toward each other in response to an increase in the force, and the second ends of the beams move away from each other in response to the increase in the force; and at least one stabilizer situated near the one side of the elevator car frame, the at least one stabilizer being configured to prevent the elevator car frame from tipping away from the vertical surface.

2. The elevator of claim 1, wherein each of the drive wheels comprises a wheel and a motor supported at least partially within the wheel.

3. The elevator of claim 1, wherein the beams move in a first direction and the force is in a second, different direction.

4. The elevator of claim 3, wherein the first direction is horizontal and the second direction is vertical.

5. The elevator of claim 4, wherein the force is based on a load on the elevator car frame.

6. The elevator of claim 3, wherein the biasing mechanism includes an actuator portion that moves in the second direction in response to a change in the force;

the actuator portion moves in response to the increase in the force to cause movement of the first ends of the beams toward each other; and the actuator portion moves in response to a decrease in the force to allow movement of the first ends of the beams away from each other.

7. The elevator of claim 6, wherein the actuator portion moves along the second direction.

8. The elevator of claim 7, wherein the actuator portion includes an angled surface that has a first profile along a portion of the angled surface and a second profile along a second portion of the angled surface, the first profile includes a first angle that is steeper than a second angle of the second portion, and the second portion of the angled surface causes movement of the first ends of the beams in response to the force being above a preselected threshold.

9. The elevator of claim 8, wherein the second profile includes a curved surface.

10. The elevator of claim 1, comprising a vertical support member that includes the vertical surfaces and wherein the vertical support member includes at least one reaction surface that is transverse to the vertical surfaces; and the stabilizer is received against the at least one reaction surface.

11. The elevator of claim 10, wherein the vertical support comprises an I-beam having a web and a flange at each end of the web;

the web defines the vertical surfaces; and at least one of the flanges defines the at least one reaction surface.

12. The elevator of claim 11, wherein the stabilizer comprises at least one roller that is received against the at least one reaction surface on the at least one of the flanges.

* * * * *